US006042420A

United States Patent [19]

Long

[11] Patent Number: 6,042,420

[45] Date of Patent: Mar. 28, 2000

[54] ELECTRICAL CONNECTOR AND BOARDLOCK WITH MINIMAL FOOTPRINT

[75] Inventor: Michael D. Long, Harrisburg, Pa.

[73] Assignee: The Whitaker Corporation, Wilmington, Del.

[21] Appl. No.: 09/256,164

[22] Filed: Feb. 23, 1999

[51] Int. Cl.[7] ..... H01R 13/73

[52] U.S. Cl. ..... 439/570

[58] Field of Search ..... 439/569–573, 439/83

[56] References Cited

U.S. PATENT DOCUMENTS

| | | | |
|---|---|---|---|
| 3,803,533 | 4/1974 | Taplin | 339/91 |
| 4,629,278 | 12/1986 | Norton et al. | 339/134 |
| 4,826,442 | 5/1989 | Douty et al. | 439/92 |
| 4,943,244 | 7/1990 | Teck et al. | 439/567 |
| 5,007,844 | 4/1991 | Mason et al. | 439/68 |
| 5,066,237 | 11/1991 | Shiley | 439/82 |
| 5,096,440 | 3/1992 | Katsumata | 439/570 |
| 5,120,256 | 6/1992 | Walden | 439/553 |
| 5,145,386 | 9/1992 | Berg et al. | 439/83 |
| 5,186,654 | 2/1993 | Enomoto et al. | 439/570 |
| 5,228,870 | 7/1993 | Gorenc et al. | 439/571 |
| 5,249,983 | 10/1993 | Hirai | 439/573 |
| 5,259,789 | 11/1993 | Patel et al. | 439/570 |
| 5,318,464 | 6/1994 | DiMondi et al. | 439/553 |
| 5,395,265 | 3/1995 | DiMondi et al. | 439/553 |
| 5,547,384 | 8/1996 | Benjamin | 439/79 |
| 5,599,207 | 2/1997 | Lai | 439/567 |
| 5,622,519 | 4/1997 | Bixler et al. | 439/570 |
| 5,626,482 | 5/1997 | Chan et la. | 439/74 |
| 5,735,696 | 4/1998 | Niitsu et al. | 439/65 |
| 5,893,764 | 4/1999 | Long | 439/570 |

FOREIGN PATENT DOCUMENTS 0 210 686 2/1987 European Pat. Off. .

*Primary Examiner*—Gary F. Paumen
*Attorney, Agent, or Firm*—Robert Kapalka

[57] ABSTRACT

An electrical connector which is mountable on a circuit board includes a housing (10) having a board-mounting face (13), a channel (38) which opens into the housing from the board-mounting face, and a pair of grooves (36, 37) which extend from the channel in respective opposite directions parallel to the board-mounting face. A boardlock (20) has a pair of oppositely extending wings (24) which are mounted in the grooves, a body which extends through the channel, and a base (22) which is engageable with the circuit board. The channel (38) and the pair of grooves (36, 37) are open to a side of the housing for receiving the boardlock in a direction parallel to the board mounting face (13). The boardlock resides completely within a lateral outline of the housing.

13 Claims, 4 Drawing Sheets

ELECTRICAL CONNECTOR AND BOARDLOCK WITH MINIMAL FOOTPRINT

FIELD OF THE INVENTION

The invention relates to an electrical connector including a housing having a boardlock which secures the housing to a circuit board.

BACKGROUND OF THE INVENTION

An electrical connector which is mounted on a circuit board generally has at least one boardlock which secures the housing to the circuit board. The boardlock is a separate member that is held by the electrical connector, and the boardlock has a retention section that is secured to the circuit board either by self-retention in a circuit board hole or by solder attachment to the circuit board. A solderable boardlock commonly attaches to the side of an electrical connector and extends to a solderable foot at the bottom of the connector. Due to the constant trend toward miniaturization of electrical components, it is desirable that the area of the circuit board covered by an electrical connector be kept to a minimum. In order to accomplish this, it is known for an electrical connector with solderable boardlocks to have the solder feet of the boardlocks disposed beneath the electrical connector body. See, for example, U.S. Pat. Nos. 5,186,654 and 5,395,265. Still, there is a need for an electrical connector having a simple and inexpensive boardlock which is easy to install in the connector and which minimizes the area of the circuit board covered by the connector.

SUMMARY OF THE INVENTION

An electrical connector which is mountable on a circuit board comprises a housing having a board-mounting face, a channel which opens into the housing from the board-mounting face, a pair of grooves which extend from the channel in respective opposite directions parallel to the board-mounting face, a boardlock having a pair of oppositely extending wings which are mounted in respective ones of the grooves, a body which extends through the channel, and a base which is engageable with the circuit board.

According to one aspect, the channel and the pair of grooves are open to a side of the housing for receiving the boardlock in a direction parallel to the board mounting face.

According to another aspect, the boardlock resides completely within a lateral outline of the housing.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
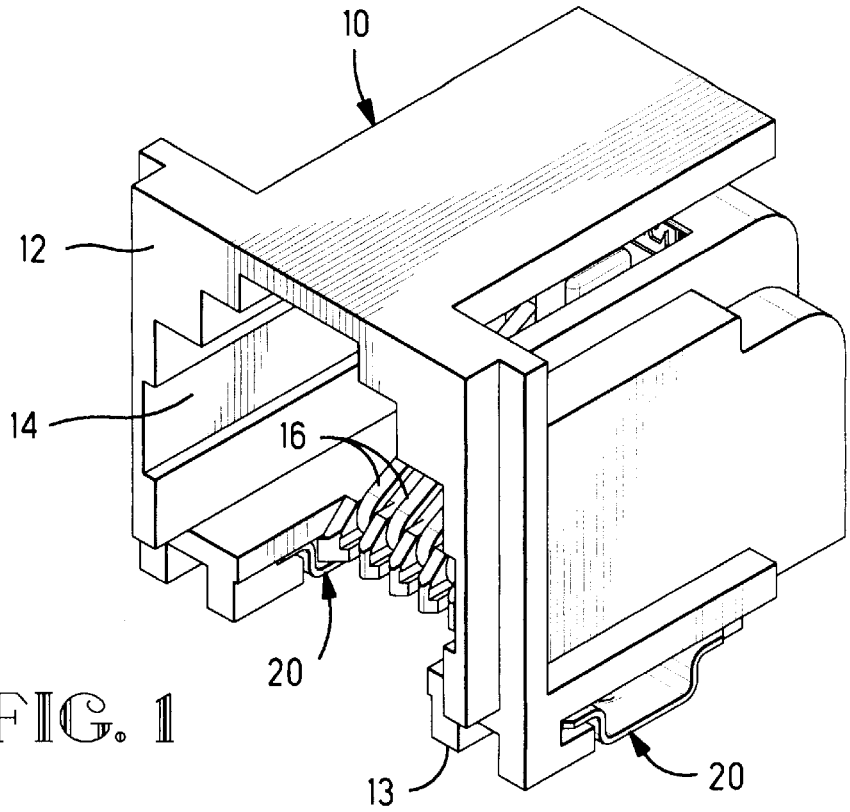
FIG. 1 is a top front isometric view of an electrical connector according to the invention.
Figure 2:
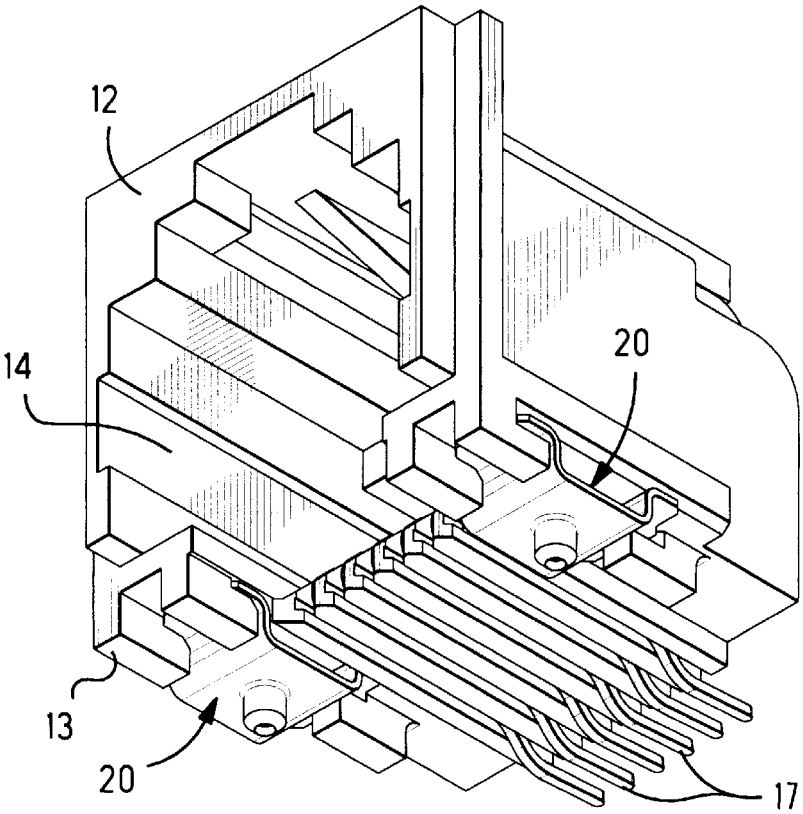
FIG. 2 is a bottom front isometric view of the connector.

As shown in FIGS. 1 and 2, an electrical connector according to the invention comprises a dielectric housing 10 having a front mating face 12 and a circuit board mounting face 13. A cavity 14 in the housing is open through the front mating face and is dimensioned to receive a mating electrical connector (not shown).

The connector which is shown in the drawings is a telephone modular jack which can receive a mating modular plug. However, it should be understood that the invention may be embodied in various other types of electrical connectors, all of which are considered to be within the scope of the invention.

The housing 10 holds a plurality of electrical contacts each having a mating section 16 which is exposed within the cavity and a board-engaging section 17 which is exposed along a bottom of the connector. The board-engaging sections are arranged in a plane to permit surface mount solder attachment to a circuit board (not shown).

Figure 3:
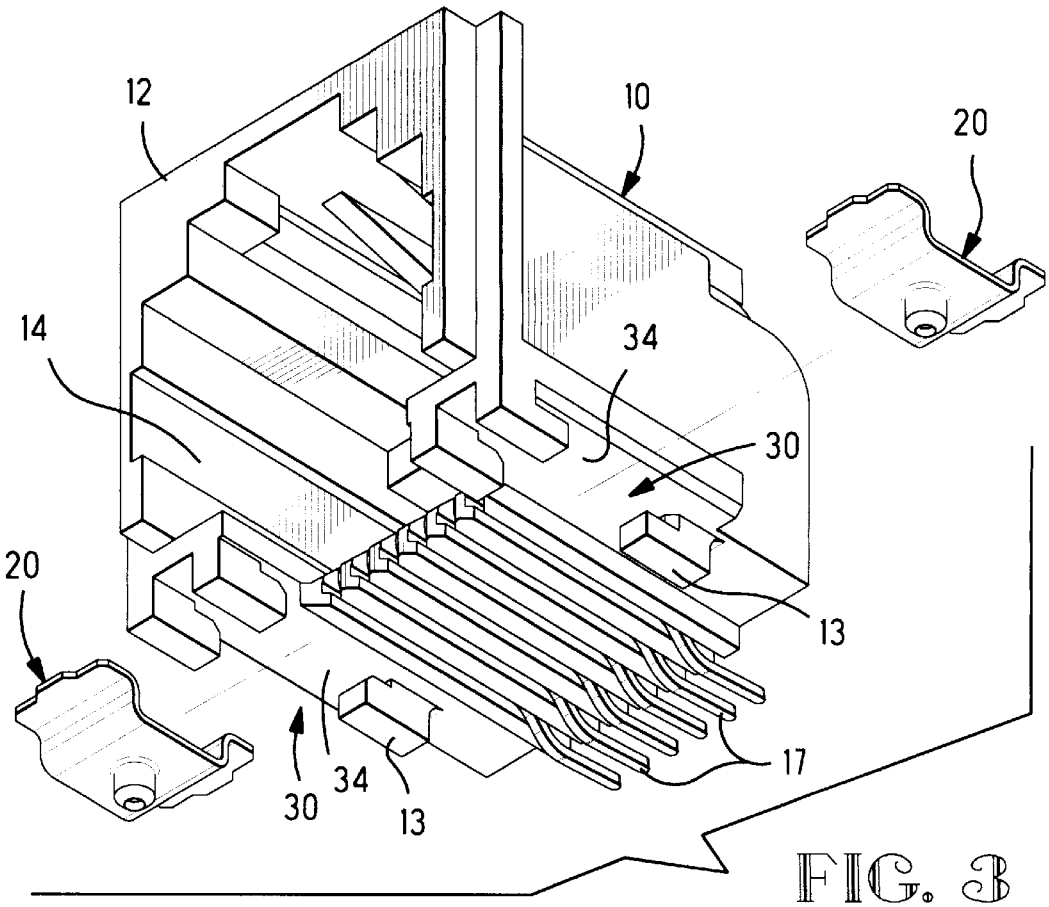
FIG. 3 is a bottom front isometric view of the connector having boardlocks exploded away.
Figure 4:
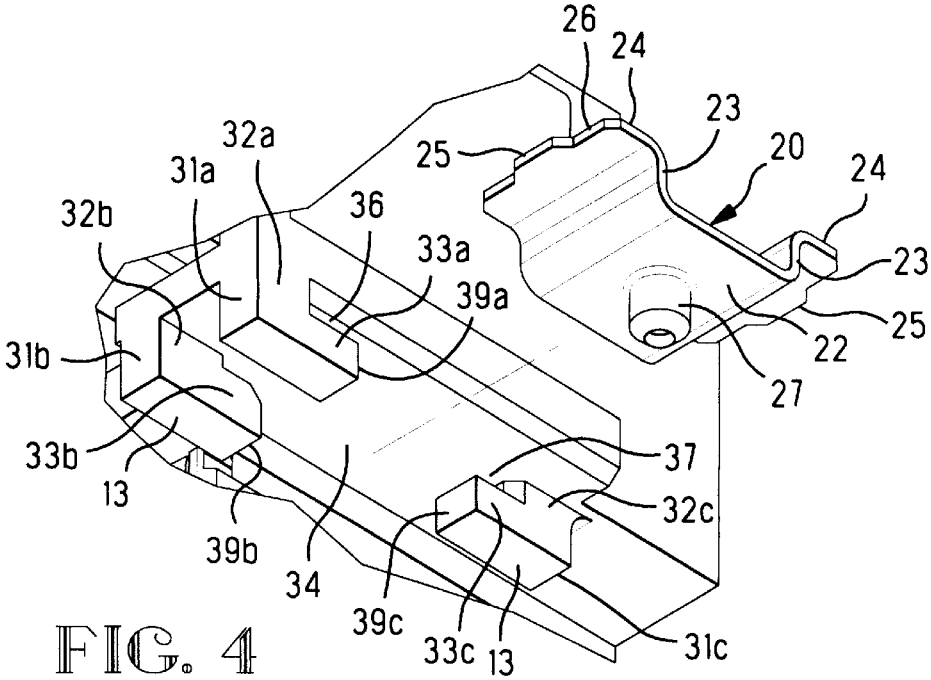
FIG. 4 is an enlarged view of a portion of the connector showing a boardlock and a retention stall.
Figure 5:
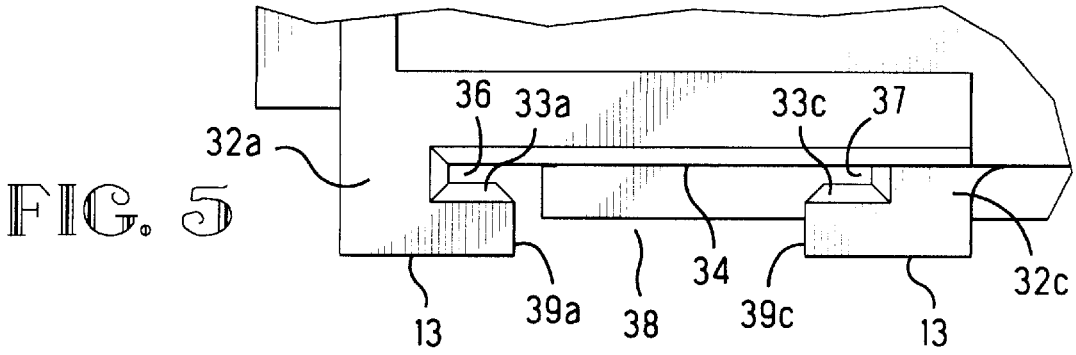
FIG. 5 is an enlarged side view of the retention stall.
Figure 6:
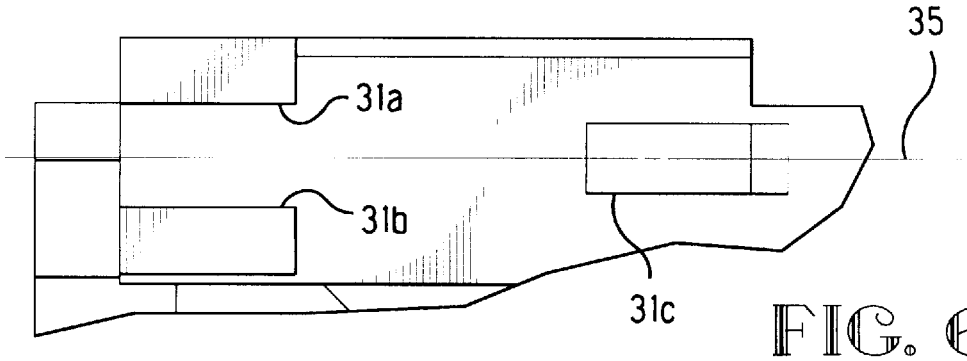
FIG. 6 is an enlarged bottom view of the retention stall.

The housing 10 holds a pair of boardlocks 20 which are shown exploded away from the housing in FIG. 3. The boardlocks are mounted in stalls 30 along the bottom of the housing. With reference also to FIGS. 4, 5 and 6, each of the stalls is defined by three retention lugs 31*a*, 31*b*, 31*c* which extend below a bottom face 34 of the housing. As best seen in FIG. 6, the three lugs are arranged in a triangular array with a pair of lugs 31*a*, 31*b* being spaced-apart at a front of the housing, and a single lug 31*c* being disposed toward a rear of the housing along an axis 35 that extends medially between the pair of lugs 31*a*, 31*b*. The three lugs are spaced-apart at selected distances so as to cooperate with the boardlock in order to retain the boardlock in the stall as will be described.

Each of the lugs 31*a*, 31*b*, 31*c* includes a vertical pillar 32*a*, 32*b*, 32*c* and a horizontal ledge 33*a*, 33*b*, 33*c* that is spaced from the bottom face 34. These ledges form a pair of opposed grooves 36, 37 as shown in FIG. 5. The front groove 36 is defined by the pair of ledges 33*a*, 33*b*, while the rear groove 37 is defined by the single ledge 33*c*. Both grooves 36 and 37 are open toward an outside of the housing. Bottom surfaces of the lugs 31*a*, 31*b*, 31*c* define the circuit board mounting face 13 of the housing. The stall 30 includes a channel 38 which is open along an end face 39*a*, 39*b*, 39*c* of each ledge between the board mounting face 13 and the grooves 36, 37.

Figure 7:
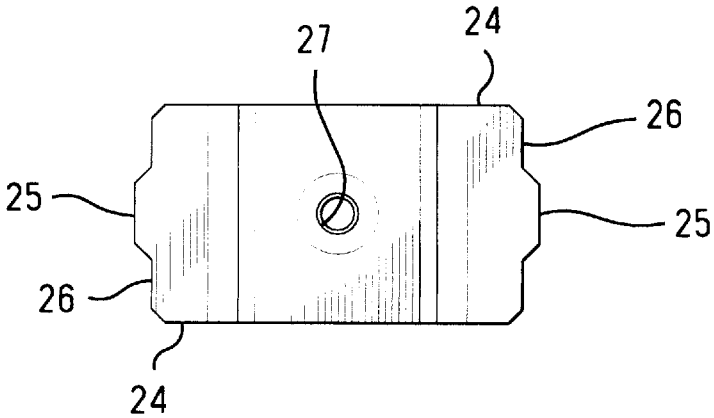
FIG. 7 is an enlarged top plan view of the boardlock.
Figure 8:
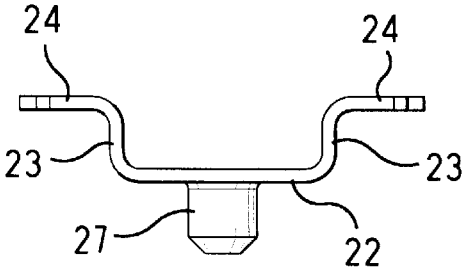
FIG. 8 is an enlarged side view of the boardlock.

With reference to FIGS. 7 and 8, each of the boardlocks 20 is an integral body which is stamped and formed from metal sheet material. Each of the boardlocks includes a base 22, a pair of struts 23 extending upward from the base, and a pair of wings 24 extending outward from the struts in respective opposite directions. Each wing has an extension 25 which is centered along its outer edge 26. Each boardlock has a post 27 which is drawn or distended below the base 22.

The boardlocks 20 are installed from opposite sides of the housing in lateral directions into their respective stalls. The wings 24 of each boardlock are installed into the front and rear grooves 36, 37. The boardlocks are dimensioned so that each is received in its stall with a slight interference fit. In particular, each boardlock has a dimension between its outer edges 26 which is greater than a dimension between a plane of the pillars 32*a*, 32*b* and the pillar 32*c*. This interference tends to pivot the pair of struts 23 toward each other, and tends to pivot the pillars 32*a*, 32*b* away from the pillar 32*c*. When the extension 25 of the front wing 24 passes beyond the pillar 32*a*, the extension becomes captured in a gap between the pair of pillars 32*a*, 32*b*. Simultaneously, the extension 25 of the rear wing becomes lodged in the rear groove 37. The boardlock is retained in the stall by an interference fit of the boardlock between the single lug 31*c* and the pair of lugs 31*a*, 31*b*, which interference fit serves to keep the front extension 25 captured between the pair of pillars 32*a*, 32*b*.

After installation in the housing 10, the base 22 of each boardlock can be surface mount soldered to a pad on a circuit board. A solder joint will be formed primarily around edges of the base, that is, along the thickness of the sheet material from which it is made. The post 27 is insertable into a hole in the circuit board hole both for positioning the boardlock on the circuit board and for increasing the solderable area or the boardlock. Alternatively, the base 22 of the boardlock can be formed with an opening instead of the post 27, thereby increasing the solderable area of the base by exposing more of the thickness of the material.

Figure 9:
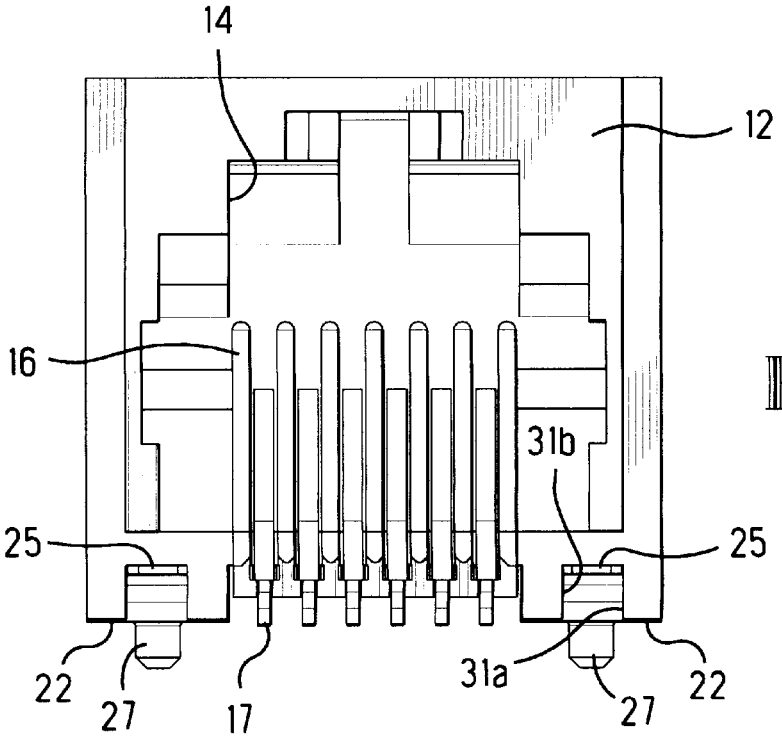
FIG. 9 is a front view of the connector with boardlocks.
Figure 10:
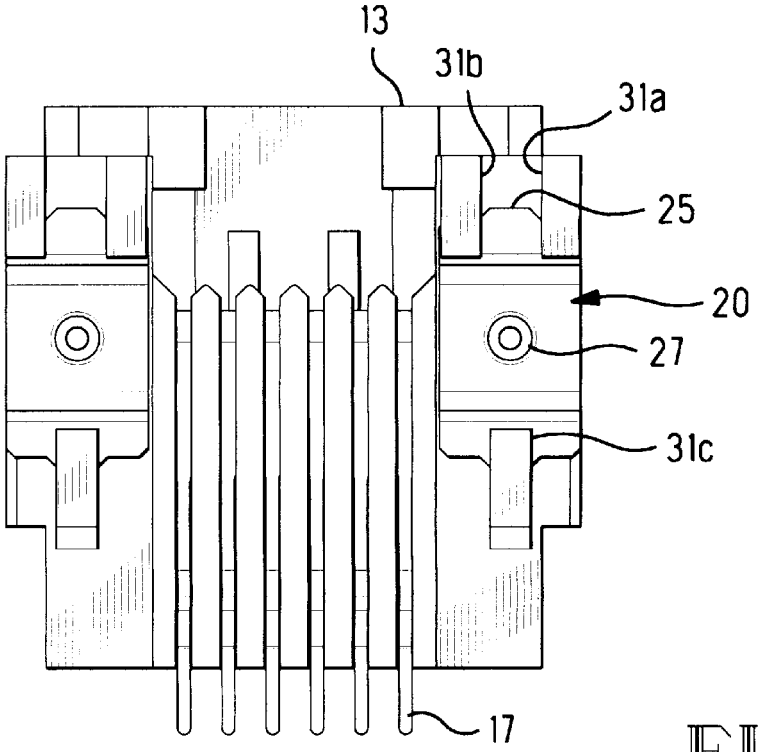
FIG. 10 is a bottom view of the connector with boardlocks.

As shown in FIGS. 9 and 10, after the boardlocks are mounted in the housing the boardlocks are entirely within a footprint or lateral outline which the housing presents to a circuit board. Thus, the invention provides an electrical connector having solderable boardlocks which do not increase the footprint of the connector.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. An electrical connector which is mountable on a circuit board, comprising:

a housing having a board-mounting face, a channel which opens into the housing from the board-mounting face, a pair of grooves which extend from the channel in respective opposite directions parallel to the board-mounting face; and a boardlock having a pair of oppositely extending wings which are mounted in respective ones of the grooves, a body which extends through the channel, and a base which is engageable with the circuit board.

2. The electrical connector of claim 1 wherein the wings are secured by an interference fit between a wall of one of the grooves and an opposite wall of the other of the grooves.

3. The electrical connector of claim 1 wherein the channel and the pair of grooves are open to a side of the housing for receiving the boardlock in a direction parallel to the board mounting face.

4. The electrical connector of claim 1 wherein the boardlock resides completely within a lateral outline of the housing.

5. The electrical connector of claim 1 wherein one of the grooves is defined by a pair of spaced-apart ledges.

6. The electrical connector of claim 5 wherein the other of the grooves is defined by single ledge that is disposed along an axis that extends medially between the pair of spaced-apart ledges.

7. The electrical connector of claim 1 wherein the housing has a pair of spaced-apart lugs, and one of the wings has an extension which is captured between the pair of spaced-apart lugs.

8. An electrical connector including a housing having a board mounting face which is mountable on a circuit board, further comprising:

a boardlock including a body having a pair of wings which extend from the body in respective opposite directions, the boardlock being disposed in a stall in the housing, the stall being configured to cooperate with the wings to secure the boardlock to the housing with each of the wings extending parallel to the board-mounting face, and the boardlock having a base which is exposed at the board mounting face for engagement with the circuit board, wherein the stall is open to a side of the housing for receiving the boardlock in a direction parallel to the board mounting face and normal to a mating direction of the connector.

9. The electrical connector of claim 8 wherein the stall includes a pair of opposed grooves, and the wings are secured by an interference fit between a wall of one of the grooves and an opposite wall of the other of the grooves.

10. The electrical connector of claim 7 wherein the boardlock resides completely within a lateral outline of the housing.

11. The electrical connector of claim 9 wherein one of the grooves is defined by a pair of spaced-apart ledges.

12. The electrical connector of claim 11 wherein the other of the grooves is defined by a single ledge that is disposed along an axis that extends medially between the pair of spaced-apart ledges.

13. The electrical connector of claim 8 wherein the stall includes a pair of spaced-apart lugs, and one of the wings has an extension which is captured between the pair of spaced-apart lugs.

* * * * *